United States Patent [19]

Adams

[11] Patent Number: 4,861,180

[45] Date of Patent: Aug. 29, 1989

[54] LOTION APPLICATOR APPARATUS WITH TIMER

[76] Inventor: David W. Adams, 748 SE. 3rd Ave., Hillsboro, Oreg. 97123

[21] Appl. No.: 196,052

[22] Filed: May 19, 1988

[51] Int. Cl.[4] ..... A45D 34/00

[52] U.S. Cl. ..... 401/195; 401/6; 401/150; 401/188 R; 401/204; 401/140

[58] Field of Search ..... 401/6, 149, 150, 146, 401/188 R, 203, 204, 195, 140

[56] References Cited

U.S. PATENT DOCUMENTS

| | | | |
|---|---|---|---|
| 864,953 | 9/1907 | Craig | 401/188 |
| 2,061,219 | 11/1936 | Wright | 401/203 X |
| 2,119,646 | 6/1938 | Pidel | 401/207 |
| 2,168,179 | 8/1939 | Tobey | 401/202 |
| 2,718,749 | 9/1955 | Florman | 401/195 X |
| 2,800,673 | 7/1957 | Lazisky | 401/188 |
| 2,995,768 | 8/1961 | Skuratowicz | 401/146 |
| 3,036,327 | 5/1962 | Crawford | 401/150 X |
| 3,063,084 | 11/1962 | Marinus | 401/203 |
| 3,226,754 | 1/1966 | Brittain | 401/127 |
| 4,171,171 | 10/1979 | Jones | 401/150 |
| 4,276,718 | 7/1981 | Keeton | 401/131 X |
| 4,483,356 | 11/1984 | Kales | 401/6 X |

FOREIGN PATENT DOCUMENTS

| | | | |
|---|---|---|---|
| 3427079 | 1/1986 | Fed. Rep. of Germany | 401/6 |

*Primary Examiner*—Steven A. Bratlie

*Attorney, Agent, or Firm*—Leon Gilden

[57] ABSTRACT

A lotion applicator apparatus is set forth incuding an applicator member configured as a human hand for acceptance by a user including an interior surface formed of a semi-absorbent covering, such as acrylic plush with an exterior surface including a timer mechanism formed thereon. The applicator member is formed with an orifice accepting lotion directed through an elongate conduit threadedly secured to a reservoir container. The reservoir container includes a pump plunger for forcing lotion through the conduit into the aforenoted orifice centrally located within the applicator member. The reservoir container is formed with a cap threadedly secured to a base to enable replenishment of lotion therein.

3 Claims, 2 Drawing Sheets

LOTION APPLICATOR APPARATUS WITH TIMER

BACKGROUND OF THE INVENTION

1. Field of the Invention

The field of invention relates to fluid applicators, and more particularly pertains to a new and improved fluid applicator providing lotion from a remote container directed through an elongate conduit medially of a semi-absorbent surface formed to one side of an applicator member or hand.

2. Description of the Prior Art

The use of applicators is well known in the prior art. Conventionally, they have included configurations that have been awkward in use or of expansive construction rendering their acceptance limited by ultimate users. The instant invention attempts to overcome some of the deficiencies of the prior art by utilizing an applicator surface configured as a human hand for aesthetic acceptance by ultimate users including a remote pressurized fluid reservoir to enable access to remote portions of the human anatomy during use.

Examples of prior art fluid applicators may be initially found in U.S. Pat. No. 2,119,646 to Pidel wherein a reservoir bottle is formed with an elongate conduit and a spongelike bulbous applicator tip. The Pidel patent relies on the general porosity of the applicator tip to effect distribution of fluid from the reservoir bottle and furthermore does not include a pressurizable means to direct fluid, but relies upon gravity for such flow to occur.

U.S. Pat. No. 2,168,179 to Tobey provides an applicator tip formed with an orthogonally directed opening and conduit thereto whereas in the Pidel patent. the Tobey patent depends on gravitational force to effect fluid flow.

U.S. Pat. No. 3,226,754 to Brittain wherein an applicator device is utilized of a construction employing a reservoir bottle with an applicator dauber affixed thereon and a cap provided with a recess for accepting the human finger to apply fluid by use of the dauber to remote locations, as the Brittain patent does not include any means for applying fluid under pressure or utilizing a directed conduit thereto as opposed to the instant invention.

U.S. Pat. No. 4,276,718 to Keeton sets forth an applicator wherein a cylindrical applicator is axially formed about a central rod wherein, as in other prior art, there is no means for providing pressurized fluid to an applicator surface but tends to rely on absorption of the applicator to apply a particular herbicide to plant life.

U.S. Pat. No. 4,483,356 to Kales sets forth a location applicator utilizing an extensible handle formed with an absorbent pad for accepting fluid for subsequent application. The instant invention differs from the aforenoted patents by the use of an applicator orifice receiving fluid directed under pressure from a reservoir and applying such fluid to an applicator surface lying in a generally parallel plane to said orifice.

As such, it may be appreciated that there is a continuing need for a new and improved lotion applicator that utilizes efficient and effective pressurized means for applying a lotion to remote human anatomical surfaces, and in this respect the present invention substantially fulfills this need.

SUMMARY OF THE INVENTION

In view of the foregoing disadvantages inherent in the known types of lotion applicators now present in the prior art, the present invention provides an lotion applicator wherein the same may be compactly utilized for effective distribution of lotion to remote portions of the human anatomy during periods of use. As such, the general purpose of the present invention, which will be described subsequently in greater detail, is to provide a new and improved lotion applicator which has all the advantages of the prior art lotion applicators and none of the disadvantages.

To attain this, the present invention comprises a lotion applicator formed with a hand-shaped applicator member with an interior or palm surface formed with a directed orifice in a plane generally parallel to the palm surface of the applicator wherein a timer device is secured within the exterior surface of the applicator member for timing of a sunbathing event subsequent to application of lotion wherein a directed conduit receives lotion from an associated reservoir formed with a manually displaceable pump member to effectively pressurize lotion within the reservoir and direct same to the palm surface of the applicator hand.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based , may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lotion applicator which has all the advantages of the prior art lotion applicators and none of the disadvantages.

It is another object of the present invention to provide a new and improved lotion applicator which may be easily and efficiently manufactured and marketed.

It is a further object of the present invention to provide a new and improved lotion applicator which is of a durable and reliable construction.

An even further object of the present invention is to provide a new and improved lotion applicator which is susceptible of a low cost of manufacture with regard to both materials and labor, and which accordingly is then susceptible of low prices of sale to the consuming public, thereby making such lotion applicators economically available to the buying public.

Still yet another object of the present invention is to provide a new and improved lotion applicator which provides in the apparatuses and methods of the prior art some of the advantages thereof, while simultaneously overcoming some of the disadvantages normally associated therewith.

Still another object of the present invention is to provide a new and improved lotion applicator wherein remote and difficult to reach portions of the human anatomy are accessible by means of an aesthetically pleasing applicator surface configured as a human hand formed with an outlet orifice in a plane generally parallel to the palm surface of the applicator hand with a timer secured therein for timing of a sunbathing event.

Yet another object of the present invention is to provide a new and improved lotion applicator wherein a remote reservoir supplies lotion under pressure to the applicator surface of the applicator apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
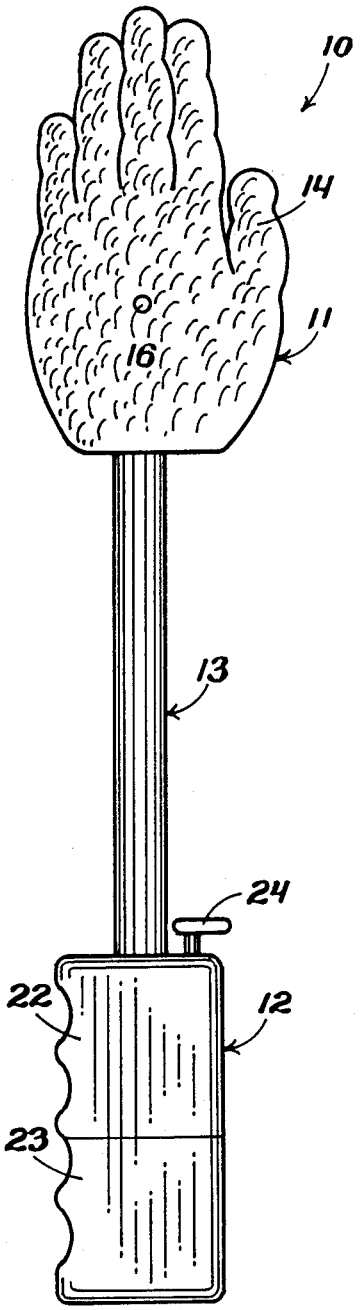
FIG. 1 is an orthographic front view taken in elevation of the instant invention.
Figure 2:
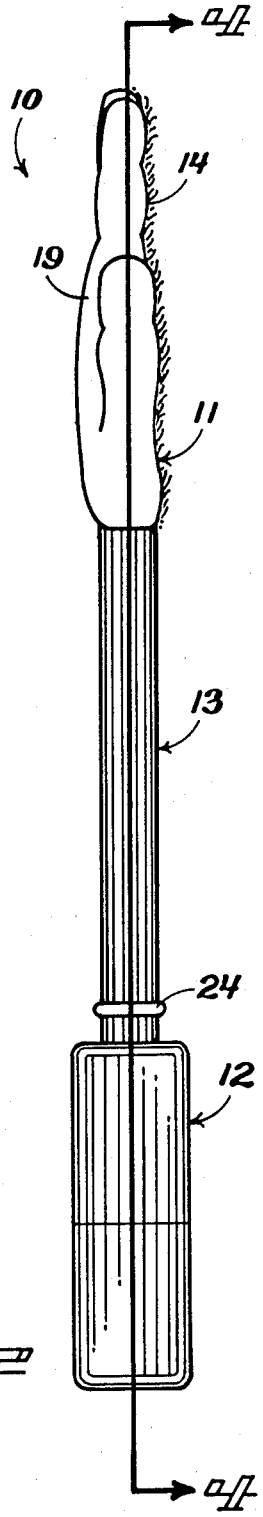
FIG. 2 is a side orthographic view of the instant invention taken in elevation.
Figure 3:
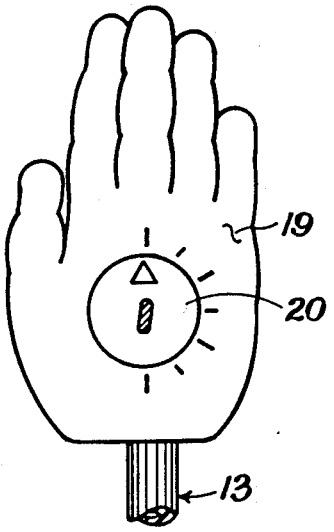
FIG. 3 is an orthographic view taken in elevation of the exterior surface of the applicator member.
Figure 5:
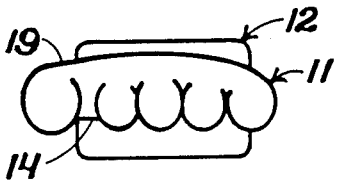
FIG. 5 is an orthographic top view of the lotion applicator apparatus.
Figure 4:
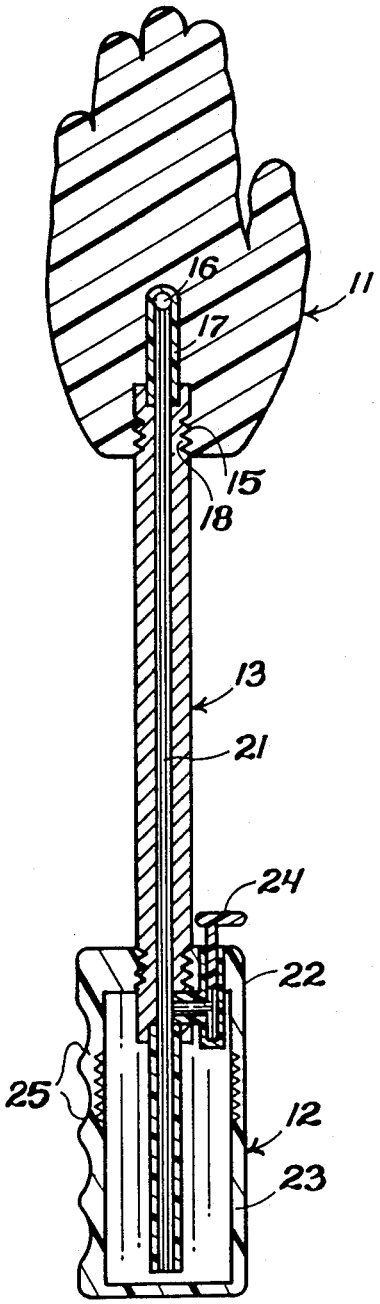
FIG. 4 is an orthographic view taken along the lines 4—4 of FIG. 2 in the direction indicated by the arrows.

With reference now to the drawings, and in particular to FIGS. 1 to 5 thereof, a new and improved lotion applicator apparatus embodying the principles and concepts of the present invention and generally designated by the reference numeral 10 will be described.

More specifically, it will be noted that the lotion applicator apparatus 10 essentially comprises a hand-shaped applicator member 11 configured for psychological acceptance by an ultimate user. The applicator member 11 is associated with a pressurizable reservoir container 12 by utilization of a rigid elongate axially symmetrical conduit 13. A palm surface or interior surface 14 of the applicator member 11 is formed with a semi-absorbent covering, such as acrylic plush, for the accepting and spreading of lotion received from the reservoir container 12 onto the applicator surface 14 via a fluid outlet opening 16 A threaded bore 15 within a remote end remote from the fingershaped portion of the applicator member 11 has secured thereto the conduit 13 by means of a complementarily threaded upper end 18 of the conduit 13 to enable selective removal of the applicator member 11 for cleaning and maintenance thereof. A rigid insert 17 integrally formed interiorly of the hand-shaped applicator member 11 forms a non-deformable conduit to accept flow from the channel 21 formed axially of the elongate conduit 13 and directs lotion therethrough channel 21 through the rigid insert 17 outwardly of the opening 16 onto the applicator surface 14.

The reservoir container 12 is formed with a threaded cap securable to a base 23 by means of a complementarily threaded connection. Furthermore, the exterior of the reservoir container 12 is formed with a contoured finger grip exterior 25 to enhance manual grasping by an ultimate user. A pump plunger 24 is positioned and formed through an exterior surface of the cap 22 to pressurize lotion within the reservoir container 12 and direct same through the channel 21.

As to the manner of usage and operation of the present invention, the same should be apparent from the above description. An ultimate user merely grasps the reservoir container 12 by use of the contoured finger of exterior 25 and by application of manual reciprocating action onto the pump plunger 24, lotion is directed through the elongate conduit 13 and directed onto the interior surface 14 of the applicator member 11.

Additionally, a timer mechanism 20 is integrally formed into the applicator member 11 through the exterior surface 19 to enable an ultimate user of the instant invention to time a sunbathing event subsequent to application of lotion thereon to further minimize hazards of overexposure to sun in addition to application of lotion onto a sunbather.

With respect to the above description then, it is to be realized that the optimum dimensional relationships for the parts of the invention, to include variations in size, materials, shape, form, function and manner of operation assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fluid applicator apparatus for applying a fluid to an individual comprising, an applicator means for receiving fluid remotely from a container means including, a forwardly directed applicator surface coextensive with an exterior surface, and an elongated rigid conduit means formed with an interior coaxial channel secured at one end to a first end of said applicator means between said applicator surface and said exterior surface for directing said fluid to said applicator surface, and said container means rigidly secured to said conduit means at a remaining end of said conduit means for supplying said fluid to said conduit means under pressure, and wherein said applicator means includes a rigid elongate insert formed with a channel for accepting fluid from said conduit means and directing said fluid to an opening formed medially of said applicator surface, and wherein said opening is oriented generally parallel to said applicator surface, and wherein said exterior surface is formed with a timer spaced in an opposed overlying orientation to said applicator surface for timing a sunbathing event subsequent to application of fluid to said individual wherein said fluid comprises suntan lotion, and wherein said container means is formed with a base threadedly securable to a cap wherein said cap is rigidly secured to said conduit means and said cap is securable to said base by complementary threads formed on said cap and said base, and wherein said cap includes an orthogonally and outwardly directed pump plunger for pressurizing fluid within said container means to provide said pressure.

2. A fluid applicator apparatus as set forth in claim 1 wherein said semi-absorbent covering is integrally formed only to said applicator surface for accepting and maintaining fluid within said covering for ultimate application to said individual.

3. A fluid applicator apparatus as set forth in claim 1 wherein a rigid insert is axially aligned with a channel axially formed within said conduit means and wherein said conduit means is threadedly securable to said first end of said applicator means to enable maintenance of said applicator means while maintaining said insert within said applicator means.

* * * * *